US008369752B2

(12) United States Patent
Furuta et al.

(10) Patent No.: US 8,369,752 B2
(45) Date of Patent: Feb. 5, 2013

(54) IMAGE FORMING APPARATUS

(75) Inventors: Tatsuya Furuta, Fuchu (JP); Toshiki Masuda, Okazaki (JP); Hiroyuki Tokimatsu, Hino (JP); Hiroshi Akita, Musashino (JP)

(73) Assignee: Konica Minolta Business Technologies, Inc. (JP)

( * ) Notice: Subject to any disclaimer, the term of this patent is extended or adjusted under 35 U.S.C. 154(b) by 342 days.

(21) Appl. No.: 12/869,257

(22) Filed: Aug. 26, 2010

(65) Prior Publication Data

US 2011/0052222 A1 Mar. 3, 2011

(30) Foreign Application Priority Data

Sep. 1, 2009 (JP) ..... 2009-201357

(51) Int. Cl.
*G03G 15/08* (2006.01)

(52) U.S. Cl. ..... 399/259; 399/62; 399/260

(58) Field of Classification Search ..... 399/255, 399/256, 258–260, 53, 58, 62
See application file for complete search history.

(56) References Cited

U.S. PATENT DOCUMENTS

| | | | | |
|---|---|---|---|---|
| 5,585,899 | A * | 12/1996 | Palumbo et al. | 399/258 |
| 5,826,150 | A * | 10/1998 | Folkins | 399/260 |
| 5,923,931 | A * | 7/1999 | Kishimoto | 399/256 |
| 6,415,125 | B1 * | 7/2002 | Yamamoto et al. | 399/255 |
| 2003/0072590 | A1 * | 4/2003 | Shimaoka et al. | 399/258 |

FOREIGN PATENT DOCUMENTS

| | | | |
|---|---|---|---|
| JP | 9-204105 | A | 8/1997 |
| JP | 10-63074 | A | 3/1998 |
| JP | 2006-71859 | A | 3/2006 |

* cited by examiner

*Primary Examiner* — Susan Lee
(74) *Attorney, Agent, or Firm* — Cantor Colburn LLP

(57) ABSTRACT

An image forming apparatus having a development apparatus that includes: a developer storing part; a developer supply mechanism; and a surplus developer removing section; wherein the developer supply mechanism includes: a toner storing part; a carrier storing part; a developer conveying path and a conveying mechanism, both are arranged between the toner storing part and the developer storing part, and between the carrier storing part and the developer storing part; wherein the developer conveying path includes a toner ejection outlet through which a toner stored in the toner storing part is ejected and a carrier ejection outlet through which a carrier stored in the carrier storing part is ejected, and a supplying developer ejection outlet through which a supplying developer is ejected to the developer storing part; and wherein the conveying mechanism is adapted to convey the toner and the carrier while stirring them.

7 Claims, 4 Drawing Sheets

IMAGE FORMING APPARATUS

This application is based on Japanese Patent Application No. 2009-201357 filed on Sep. 1, 2009, with the Japan Patent Office, the entire content of which is hereby incorporated by reference.

BACKGROUND

1. Field of the Invention

The present invention relates to an image forming apparatus of an electrophotographic process applying development by use of a two-component developer.

2. Description of Related Art

As an image forming apparatus of an electrophotographic process, heretofore, known is an image forming apparatus mounted with a developing apparatus of a so-called trickle development process, in which a two-component developer comprising a toner and a carrier (hereinafter, also referred to as simply "a developer") is utilized, a toner triboelectrically charged by stirring with a carrier being conveyed to a development region, a toner image being formed by making a toner adhere on an electrostatic latent image formed on an image carrier, and further a used developer is gradually removed as well as an unused toner and carrier are continuously or intermittently supplied.

Generally, a two-component developer receives a stress due to a stirring motion to make additives such as a lubricant having been added on the surface of toner particles constituting a toner release from or contrary be buried into toner particles, as a result, charging ability of a developer may be deteriorated to decrease the charge amount of a toner, or fluidity of a developer may be decreased to make coefficient of friction between a carrier and a toner high to cause a phenomenon of carrier contamination due to adhesion of a toner on a carrier; however, excessive deterioration of a developer is restrained because a unused toner is continuously or intermittently supplied as well as additives will be also supplied thereby by adopting such a trickle development process. Herein, it is difficult to make additives uniformly contact with a toner and a carrier even when additives are independently supplied as they are into a development apparatus.

However, in such a trickle development process, since a toner and a carrier are stored in the same vessel in advance and a carrier is supplied according to supply control of a toner, there is a problem that a supply amount of a carrier cannot be directly controlled. Therefore, a supply amount of a carrier varies corresponding to a printing ratio (hereinafter, referred to as "a coverage") of an original. That is, since a toner amount supplied for image formation is large in the case of continuously printing an original having a high coverage, there is a problem that a supply amount of a carrier which is supplied simultaneously with toner supply becomes large to increase CCP (Cost Per Print: a cost per one sheet of printing paper). Further, in the case of continuously printing an original having a low coverage, since the amount of a toner supplied for image formation is very small, the supply amount of a carrier supplied simultaneously with toner supply also decreases to decrease a removal amount of a developer, which decreases an exchange amount of a carrier resulting in deterioration of a carrier, there is a problem of generation of image deterioration such as fogging and a toner scattering due to decrease of fluidity and charging ability of a developer.

To solve the above-described problems, technologies such as disclosed in JP-A 9-204105 (hereinafter, JP-A refers to Japanese Patent Publication Open to Public Inspection No.), JP-A 10-63074 and JP-A 2006-71859 are proposed.

In 2-A 9-204105 and JP-A 10-63074, as shown in FIG. 11, proposed is an image forming apparatus equipped with development apparatus 50 which supplies a toner stored in toner storing part 51 and a carrier stored in carrier storing part 52 to developer storing part 53 while independently controlling their supply amounts. In such an image forming apparatus, although a supply amount of a carrier can be directly controlled, sufficient triboelectric charging of a toner by stirring with a carrier cannot be obtained because a toner and a carrier are supplied into developer storing part 53 without being mixed or stirred in advance, which causes scatter of a charging amount between a toner supplied and a toner stored in development storing part 53 to make charging amount distribution of a toner broad, whereby there is a problem of generation of image deterioration such as fogging.

Further, in JP-A 2006-71859, proposed is an image forming apparatus equipped with development apparatus 60 in which a toner stored in toner storing part 61 and a carrier stored in carrier storing part 62 are temporarily stored in intermediate tank 64 while independently controlling the supply amounts, and a toner and a carrier are stirred while being circulated in this intermediate tank 64 to be supplied to developer storing part 63 as a supplying developer. However, in this image forming apparatus, it is difficult to rapidly supply a supplying developer of a varying trickle rate (a carrier concentration of a supplying developer) to developer storing part 63 unless the whole of a supplying developer stored in intermediate tank 64 is removed. Therefore, since supply control of a carrier cannot be minutely performed, supplying response of a carrier is insufficient and increase of CCP and deterioration of a carrier cannot be sufficiently dissolved. Further, there is also a problem that an apparatus inevitably becomes big due to installation of intermediate tank 64.

This invention has been made in view of the above-described problems, and the object is to provide an image forming apparatus which exhibits sharp charging amount distribution of a toner, restrains deterioration of a developer because of excellent supplying response of an adequate amount of a toner and a carrier, and enables to stably form high quality images for a long term.

SUMMARY

An image forming apparatus equipped with a development apparatus which is provided with a developer storing part to store a two-component developer comprising a toner and a carrier for development of an electrostatic latent image held on an image carrier, a developer supply mechanism to supply a supplying developer to the aforesaid developer storing part, and a surplus developer removing section to remove a two-component developer from the aforesaid developer storing part; said developer supply mechanism being provided with a toner storing part and a carrier storing part, a developer conveying path and a conveying mechanism arranged between, a toner storing part and a carrier storing part, and a developer storing part, a toner supply amount control section to control a toner amount supplied from a toner storing part to a developer conveying path, and a carrier supply amount control section to control a carrier amount supplied from a carrier storing part to a developer conveying path; said developer conveying path being provided with a toner ejection outlet to eject a toner stored in a toner storing part and a carrier ejection outlet to eject a carrier stored in a carrier storing part on the one end, and a supplying developer ejection outlet to eject a supplying developer on the other end; and a toner from a toner ejection outlet and a carrier from a carrier ejection outlet are conveyed from one end toward the other end while being stirred by the aforesaid conveying mechanism.

In the above-described image forming apparatus, it is preferable that the aforesaid development apparatus is further provided with a toner concentration detection section to detect a toner concentration of a two-component developer in the aforesaid developer storing part and a drive time detection section to detect drive time of the aforesaid development apparatus, and the aforesaid toner supply amount control section controls a toner amount supplied from a toner storing part to a developer conveying path depending on a toner concentration value detected by the aforesaid toner concentration detection section, as well as the aforesaid carrier supply amount control section controls a carrier amount supplied from a carrier storing part to a developer conveying path depending on a drive time value detected by the aforesaid drive time detection section.

In the above-described image forming apparatus of this invention, a toner storing part is preferably arranged upstream in the conveying direction of developer conveying path against a carrier storing part.

In the above-described image forming apparatus of this invention, possible is a constitution provided with a toner direct supply path to directly supply a developer stored in a toner storing part to a developer storing part.

DESCRIPTION OF THE PREFERRED EMBODIMENTS

In the following, this invention will be detailed.

[Image Forming Apparatus]

Figure 1:
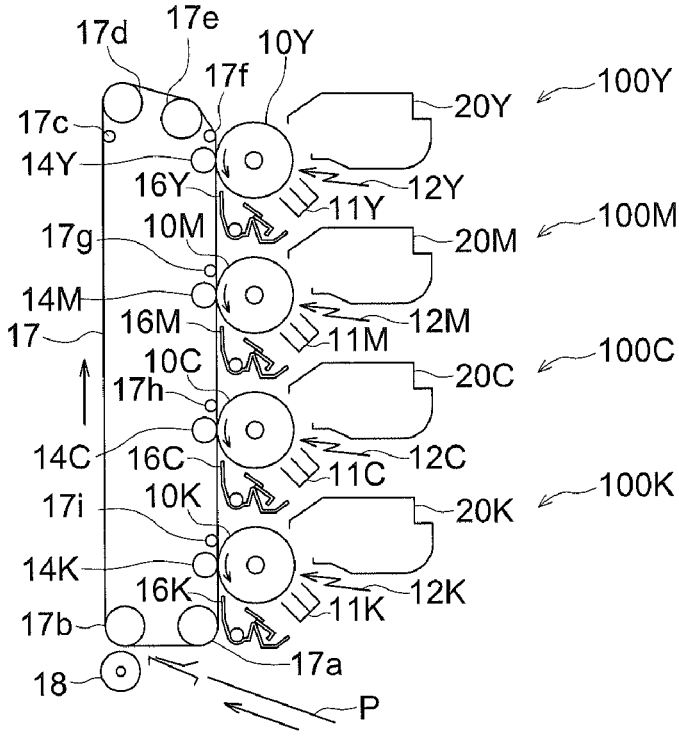
FIG. 1 is an explanation drawing to show an outline according to a constitutional example of an image forming apparatus of this invention.

FIG. 1 is an explanation drawing to show an outline according to a constitutional example of an image forming apparatus of this invention.

An image forming apparatus of this invention may be a tandem type color image forming apparatus in which, for example, four sets of image forming units 100Y, 100M, 100C and 100K are vertically arranged in a row along intermediate transfer belt 117 which is an intermediate transferring member.

Image forming units 100Y, 100M, 100C and 100K each, being hanged to be circumscribed against rollers 17*a*-17*i*, are provided with photoconductor drums 10Y, 10M, 10C and 10K which are image carriers and move following to intermediate transfer belt 17 which circulating shifts in the arrow head direction by a drive source (not shown in the drawing), charging section 11Y, 11M, 11C and 11K comprising a scorotron charger, which are arranged parallel to the rotation axis of photoconductor drums 10Y, 10M, 10C and 10K and provide uniform potential on the surfaces of said photoconductor drums 10Y, 10M, 10C and 10K by corona discharge of a same polarity with a toner, exposure section 12Y, 12M, 12C and 12K which perform scanning parallel to the rotation axis of photoconductor drums 10Y, 10M, 10C and 10K with such as a polygon mirror and perform image exposure based on image data to form an electrostatic latent image on the surfaces of photoconductor drums 10Y, 10M, 10C and 10K which have been uniformly charged, and development apparatuses 20Y, 20M, 20C and 20K having a developer supplying mechanism according to this invention which convey a toner onto the surfaces of photoconductor drums 10Y, 10M, 10C and 10K to visualize the aforesaid electrostatic latent image.

Photoconductor drums 10Y, 10M, 10C and 10K are constituted of a cylindrical metal substrate made of an aluminum material on the outer circumferential surface of which an organic photoconductor layer (an OPC) provided with an over coat layer (a protective layer) is formed, and, for example, have an outer diameter of 100 mm.

Further, intermediate transfer belt 17, for example, is an endless belt having a volume resistivity $10^{12}$-$10^{16}$ Ω·cm and specifically, is preferably one provided with a two-layer constitution comprising a substrate made of semi-conductor film having a thickness of 0.1-1.0 mm, which is made of engineering plastic such as modified polyimide, thermally curable polyimide, ethylene tetrafluoroethylene copolymer, polyfluorovinilidene and nylon alloy in which a conductive material is dispersed, and the outer surface of which is preferably coated with fluorine coating having a thickness of 5-50 μm as a toner filming prevention layer.

A substrate constituting an intermediate transfer belt 17 also includes a substrate comprising semiconductor rubber having a thickness of 0.5-2.0 mm, which is made of such as silicone rubber and urethane rubber in which conductive material is dispersed, other than the above-described substrate made of semiconductor film.

Herein, in FIG. 1, 16Y, 16M, 16C and 16K are cleaning section to recover residual toner remaining on photoconductor drums 10Y, 10M, 10C and 10K after the first transfer.

In this example, a yellow toner image is formed by image forming unit 100Y, a magenta toner image is formed by image forming unit 100M, a cyan toner image is formed by image forming unit 100C, and a black toner image is formed by image forming unit 100K.

In such an image forming apparatus, toner images of each color formed on photoconductor drums 10Y, 10M, 10C and 10K of image forming units 100Y, 100M, 100C and 100K each are overlapped by being successively transferred from first transfer section 14Y, 14M, 14C and 14K, for example, comprising a corona discharger on circulating shifting intermediate transfer belt 17 to form a color toner image, which is transferred at a time on recording material P conveyed from a paper supplying tray (not shown in the drawing) in second transfer section 18 and is fixed in a fixing apparatus not shown in the drawing, followed by being removed out of the machine.

Recording paper P includes various types, specifically, such as plain paper from light paper to heavy paper, high grade paper, coated printing paper such as art paper and coated paper, Japanese paper and postcard paper available on the market, plastic film for OHP application and cloth, however, is not limited thereto.

[Development Apparatus]

And, development apparatuses 20Y, 20M, 20C and 20K which are installed in an image forming apparatus of this invention have a same constitution except that colors of a toner filled are different from each other. In the following, development apparatus 20Y will be explained as a representative.

Figure 2:
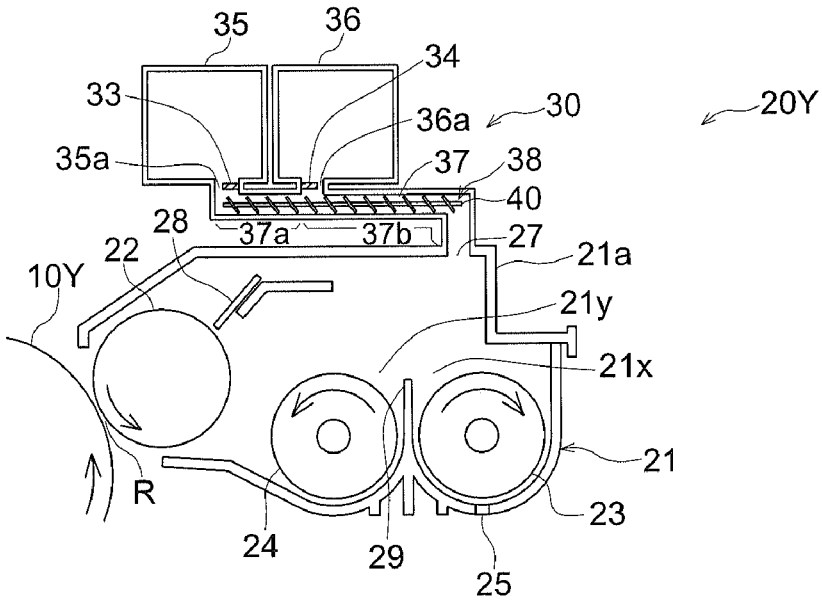
FIG. 2 is an explanation drawing to show an outline of a constitutional example of a development apparatus according to the image forming apparatus of FIG. 1.
Figure 3:
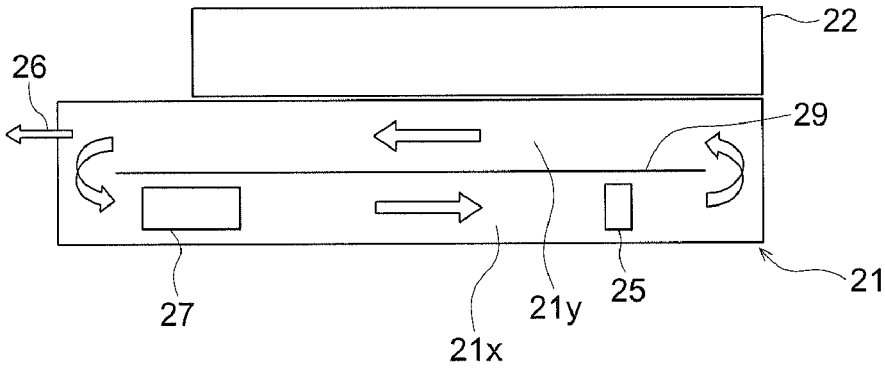
FIG. 3 is a plane drawing to schematically show a part of a development roller and a developer storing part in the development apparatus of FIG. 2.

FIG. 2 is an explanation drawing to show an outline of a constitutional example of a development apparatus according to an image forming apparatus of this invention, and FIG. 3 is a plane drawing to schematically show a development roller and a part of a developer storing part in the development apparatus of FIG. 2.

This development apparatus 20Y belongs to those of a trickle development process in which development is performed while a toner and a carrier each are continuously or intermittently supplied into developer storing part 21 and an excess developer (hereinafter, also referred to as "a surplus developer") in developer storing part 21 is continuously or intermittently removed.

Development apparatus 20Y, as shown in FIGS. 2 and 3, is constituted of developer storing part 21 which stores a developer comprising a toner and a carrier for development of an electrostatic latent image carried on photoconductor drum 10Y, development roller 22 which is arranged in this developer storing part 21 and holds and conveys a developer to development region R, developer supply mechanism 30 which supplies supplying developer described later to developer storing part 21, a surplus developer removing section (not shown in the drawing) which removes a surplus developer from developer storing part 21, toner concentration detection section 25 which detects a toner concentration of a developer in development storing part 21 and a drive time detection section (not shown in the drawing) which detects drive time of development apparatus 20Y.

Developer supplying mechanism 30 is provided with toner storing part 35 to store a supplying toner (hereinafter, also referred to as "a new toner"), carrier storing part 36 to store a unused carrier (hereinafter, also referred to as "a new carrier"), developer conveying path 37 and conveying mechanism 38 which are arranged between, toner storing part 35 and carrier storing part 36, and developer storing part 21, toner supply amount control section 33 which controls an amount of a new toner supplied to developer conveying path 37 from toner storing part 35 depending on a toner concentration value detected in toner concentration detection section 25, and carrier supply amount control section 34 which controls an amount of a new carrier supplied to developer conveying path 37 from carrier storing part 36 depending on a drive time value detected in a drive time detection section.

Herein, a new toner may be an unused toner or a so-called recycle toner having been recovered by cleaning section 16Y.

Developer conveying path 37 is provided with toner ejection outlet 35*a* to eject a new toner stored in toner storing part 35 and carrier ejection outlet 36*a* to eject a new carrier stored in carrier storing part 36 at the one end, and a supplying developer ejection outlet 27 to eject a supplying developer to developer storing part 21 on the other end.

Herein, in this invention, a supplying developer refers to a developer comprising a new toner ejected from toner ejection outlet 35*a* and a new carrier ejected from carrier ejection outlet 36*a*.

Toner storing part 35 is arranged upstream against carrier storing part 36 in the conveying direction of developer conveying path 3'7. That is, such a constitution naturally arranges toner ejection outlet 35*a* upstream against carrier ejection outlet 36*a* in the conveying direction of developer conveying path 37. Developer conveying path 37 having such a constitution exhibits high conveying efficiency of a supplying developer.

Conveying mechanism 38 has a constitution in which a stirring conveying member 40, for example, comprised of a rotating body having spiral fans, which is arranged on developer conveying path 37 extending along the direction of developer conveying path 37 is provided, and by drive of this stirring conveying member 40, a new toner ejected from toner ejection outlet 35*a* and a new carrier ejected from carrier ejection outlet 36*a* are transferred in order toward one direction without being recycled on developer conveying path 37 while being stirred. In this case, drive of stirring conveying member 40 may be synchronized with drive of development apparatus 20Y or may be controlled according to drive time of development apparatus 20Y.

Further, in the case of stirring conveying member 40 being constituted of a rotation body having spiral fans, a pitch width of spiral fans, for example, on developer conveying path 37, is set to 30-50 mm in section 37*a* from toner ejection outlet 35*a* to just before carrier ejection outlet 36*a*, and set to 15-25 mm in section 37*b* from carrier ejection outlet 36*a* to supplying developer supply inlet 27. In this manner, by setting a pitch width of spiral fans in section 37*b* narrower than a pitch width of spiral fans in section 37*a*, that is, by decreasing a conveying speed, it is possible to sufficiently stir a new toner ejected from toner ejection outlet 35*a* and a new carrier ejected from carrier ejection outlet 36*a*.

Figure 4:
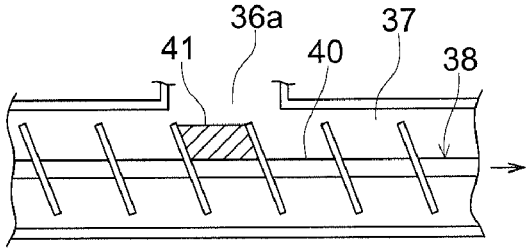
FIG. 4 is an explanation drawing to magnifying show an example of a part of a developer conveying path and a conveying mechanism in an image forming apparatus of this invention.
Figure 5:
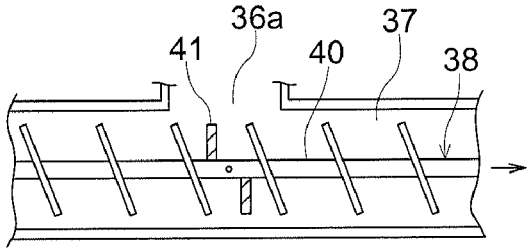
FIG. 5 is an explanation drawing to magnifying show another example of a part of a developer conveying path and a conveying mechanism in an image forming apparatus of this invention.

Further, in conveying mechanism 38, convey disturbing member 41 can be arranged in stirring conveying member 40 at the meeting position of a new toner ejected from toner ejection outlet 35*a* and a new carrier ejected from carrier ejection outlet 36*a*, on developer conveying path 37 (refer to FIGS. 4 and 5). By arranging this convey disturbing member 41, it is possible to decrease the conveying speed at the aforesaid meeting position resulting in improved take-in ability at the meeting position.

Convey disturbing member 41, for example, in the case of stirring conveying member 40 being constituted of a rotation body having spiral fans, includes such as convey disturbing plate (refer to FIG. 4) arranged along the conveying direction between the pitches of spiral fans and a plural number of convey disturbing bars (refer to FIG. 5) arranged perpendicular against the conveying direction between the pitches of spiral fans.

Further, other convey disturbing members include, for example, such as a magnet and an electromagnet, which are on the outer bottom of a developer conveying path forming material, which forms developer conveying path 37, at the meeting position of a new toner ejected from toner ejection outlet 35*a* and a new carrier ejected from carrier ejection outlet 36*a*, on developer conveying path 37, and it is possible to control a disturbing ratio of a supplying developer by varying the influence degree of a magnetic field of this magnet or electromagnet.

In this development apparatus 20Y, specifically, developing roller 22 which is facing against photoconductor drum 10Y via development region R and is rotated anti-clock-wise as shown by the arrow head so as to be shifted to the direction opposite to photoconductor drum 10Y in development region R, supply and recovery member 24 which is rotated anti-clock-wise to supply a developer on development roller 22 at the top as well as to recover a developer returned from development roller 22 at the bottom, stirring member 23 which is rotated toward the opposite direction against said supply and recovery member 24 to mix and stir a developer while being circulated and conveyed, each are installed in development storing part 21 being stretched in the axis direction (the perpendicular direction to the paper plain in FIG. 2) and parallel with each other in a line (in left and right directions in FIG. 2) in this order in a state of being arranged in supply and recovery section 21*y* and stirring section 21*x* which each are divided by partition 29.

Herein, 28 is a developer layer adjusting member, which is comprised of a magnetic material having such as a bar form or a plate form and is arranged via a predetermined interval to development roller 22, to adjust a developer layer to be formed on the outer circumference surface of development roller 22 to a predetermined thickness.

Development roller 22 is constituted of a cylindrical development sleeve, for example, comprising a non-magnetic material such as aluminum arranged rotatable and such as a column magnetic material having plural number of magnetic poles which is arranged inside of this development sleeve so as to be fixed being separated in the circumference direction. The outer diameter of this development roller 22 is, for example, set to ϕ30 mm.

Stirring member 23 and supply and recovery member 24, for example, may have a screw form provided with spiral funs formed being stretched spirally with uniform pitches along the axis direction over the whole outer circumference of a column axis member of a column form.

The outer diameters of these stirring member 23 and supply and recovery member 24 each are, for example, set to ϕ27 mm.

In this development apparatus 20Y, a stirring circulation path of a developer is formed by stirring section 21*x* and supply and recovery section 21*y* in developer storing part 21, and supplying developer ejection outlet 27 is formed on stirring section 21*x* in roof plate 21*a* of developer storing part 21, where stirring member 23 is arranged, and upstream in the conveying direction (on the left side in FIG. 3) along said conveying direction.

By arranging supplying developer ejection outlet 27 upstream in the conveying direction on stirring section 21*x*, it is possible to prevent a supplying developer being supplied from developer conveying path 37 to development roller 22 without sufficient stirring with a developer already stored in developer storing part 21.

Further, developer removing outlet 26 to remove a surplus developer is formed at the position directly upstream to the position where supplying developer ejection outlet 27 is arranged in a stirring circulation path of a developer, that is, at the lowermost stream of supply and recovery section 21*y* where supply and recovery member 24 is arranged in developer storing part 21.

By arranging developer removing outlet 26 directly upstream to the position where supplying developer ejection outlet 27 is arranged, it is possible to restrain a supplying developer from being removed immediately before being mixed with a developer already stored.

As a surplus developer removing section, various methods can be applied without specific limitation; however, listed are such as a method to make a surplus developer in a stirring circulation path automatically overflow by setting the height of a wall surface of developer storing part 21 to lower by a predetermined height only at the portion of developer removing outlet 26, and a method to make a surplus developer in a stirring circulation path automatically overflow the wall surface of developer storing part 21 by disturbing convey of a developer by use of supply and recovery member 24 or stirring member 23 in which spiral fans partially wound to the opposite direction.

The amount of a developer according to a yellow color stored in developer storing part 21 constituting development apparatus 20Y is, for example, set to 600 g.

As toner concentration detection section 25, various methods can be applied without specific limitation; and for example, those comprising a so-called magnetic sensor in which voltage is applied on a coil and a current value varying depending on magnetic permeability is detected can be utilized. In the case of utilizing such a magnetic sensor, this magnetic sensor is, for example, arranged at the position opposing to the bottom of stirring member 23 of developer storing part 21.

Further, as toner concentration detection section 25, for example, those of a method to indirectly detect toner concentration by detecting a toner adhering amount by means of detection of reflection density of a patch image formed on photoconductor drum 10Y.

In a drive time detection section, drive time of development apparatus 20Y, that is, drive time of development roller 22, stirring member 23 and supply and recovery member 24 (including drive time by image formation and correction) during a certain time is detected.

Toner supply amount control section 33 is not specifically limited and, for example, applied can be a method in which a switching member such as a valve or a shutter is arranged in toner ejection outlet 35*a* and an amount of a new toner supplied from toner storing part 35 to developer conveying path 37 is controlled by varying an opening area of toner ejection outlet 35*a* with this switching member.

Carrier supply amount control section 34 is not specifically limited and for example, applied can be a method in which an amount of a new carrier supplied from carrier storing part 36 to developer conveying path 37 is controlled by arranging a switching member such as a valve or a shutter in carrier ejection outlet 36 to vary an opening time with this switching member. Specifically, carrier supply amount control section 34 may be provided with a constitution to control the opening time of a switching member, as shown in table 1 described below, depending on drive time of stirring conveying member 40 in conveying mechanism 38 in every 5 seconds of drive time of development apparatus 20Y.

TABLE 1

| Drive time (second) of a stirring conveying member in every 5 seconds of drive time of a development apparatus | Opening time of a switching member (second) |
|---|---|
| 0-less than 0.5 | 4 |
| 0.5-less than 1 | 2 |
| 1-less than 1.5 | 1.5 |
| 1.5-less than 2 | 1 |
| 2-less than 3 | 0.5 |
| 3-less than 4 | 0 |
| 4-less than 5 | 0 |

In development apparatus 20Y such as described above, development motions are performed as follows.

That is, a developer stored in developer storing part 21 is mixing stirred by stirring member 23 and adhered on the outer circumference surface of development roller 22 by magnetic force after having been conveyed to the outer circumference surface of development roller 22 by supply and recovery member 24, further, the thickness thereof being regulated by layer thickness control member 28 to form a developer layer made of a magnetic blush, which is conveyed to development region R, and in said development region R, development bias voltage of direct current voltage appropriately superposed with alternate current (AC) voltage is applied between development roller 22 and photoconductor drum 10Y, whereby reversal development is performed to visualize an electrostatic latent image on photoconductor drum 10Y.

On the other hand, a developer not visualized an electrostatic latent image is peeled off from development roller 22 by an action of a repulsive magnetic field of a magnetic body to be recovered by supply and recovery member 24, and is conveyed to development roller 22 by said supply and recovery member 24, directly or after having been subjected to mixing and stirring by stirring member 23.

Mixing, stirring and supplying motions by stirring member 23 and supply and recovery member 24 are performed as follows.

That is, a developer is supplied to development roller 22 after being mixing stirred to be triboelectrically charged while being conveyed in one direction along the axis by stirring member 23 in stirring section 21*x* and being mixing stirred to be triboelectrically charged while being conveyed at an equal rate in the direction opposite to the conveying direction by stirring member 23 in supply and recovery section 21*y*. A developer is circulating conveyed in these stirring section 21*x* and supply and recovery section 21*y*.

Supply motions of a supplying developer by developer supply mechanism 30 are performed as follows.

That is, the toner concentration of a developer in developer storing part 21 is detected by toner concentration detection section 25, a new toner stored in toner storing part 35 being ejected depending on the toner concentration value through toner ejection outlet 35*a* while the amount is controlled by toner supply amount control section 33, and this new toner ejected through toner ejection outlet 35*a* is supplied to developer conveying path 37. On the other hand, drive time of development apparatus 20Y is detected by a drive time detection section, a new carrier stored in carrier storing part 36 being ejected depending on said drive time value through carrier ejection outlet 36*a* while the amount is controlled by carrier supply amount control section 34, and this new carrier ejected through carrier ejection outlet 36*a* is supplied to developer conveying path 37 to be joined with a new toner supplied to development conveying path 37. Then, this supplying developer is conveyed toward supplying developer ejection outlet 27 while being stirred by conveying mechanism 38 on developer conveying path 37, and ejected through supplying developer ejection outlet 27 to be supplied to developer storing part 21.

[Two-Component Developer]

As a toner constituting a developer utilized in an image forming apparatus of this invention, various types well known in the art can be utilized without specific limitation; however, for example, a so-called polymerized toner having a volume average median diameter of 3-9 μm prepared by a polymerization method is preferably utilized. By utilizing a polymerized toner, it is possible to obtain high resolution and stable image density with respect to a formed visual image as well as to sufficiently restrain generation of fog.

Further, as a carrier constituting a developer utilized in an image forming apparatus of this invention, various types well known in the art can be utilized without specific limitation; however, for example, a ferrite carrier comprising magnetic particles having a volume average median diameter of 30-65 μm and a magnetization of 20-70 emu/g is preferably utilized. In the case of utilizing a carrier having a volume average median diameter of less than 30 μm, there is a fear of causing carrier adhesion to generate a white spotted image, while in the case of utilizing a carrier having a volume average median diameter over 65 μm, there may be a case not to form an image having uniform image density.

According to an image forming apparatus such as described above, by developer conveying path 37 and conveying mechanism 38 arranged between toner storing part 35 and carrier storing part 36, and developer storing part 21, being constituted to convey a new toner ejected through toner ejection outlet 35*a* and a new carrier ejected through carrier ejection outlet 36*a* while being stirred, sufficient toriboelectric charge can be obtained by stirring a new toner ejected through toner ejection outlet 35*a* with a new carrier ejected through carrier ejection outlet 36*a* to provide a suitable charging state, and since such a new toner is supplied to developer storing part 21, broadening of charging distribution of a toner can be restrained resulting in formation of a high quality image stably for a long term without generation of image defects such as fog. Furthermore, in developer supply mechanism 30, since a supply amount of a new carrier is controlled independently from a supply amount of a new toner by being equipped with toner supply amount control section 33 and carrier supply amount control section 34, suitable amount of a new carrier is supplied to developer conveying path 37 irrespective to a coverage of an original, and since suitable amount of a new carrier and a new toner are transferred in order on developer conveying path 37 while keeping a trickle rate having been set every time corresponding to requirement by constituting developer conveying path 37 as a non-circulating system, suitable amount a new toner and a new carrier can be supplied to developer storing part 21, whereby supplying response of a new carrier and a new toner becomes excellent and carrier deterioration is sufficiently retrained in the case of continuous printing of an original having a low coverage, and as a result an image having a high image quality can be stably formed over a long term. Further, in the case of continuous printing of an original having a high coverage, increase of CPP can be restrained.

Figure 6:
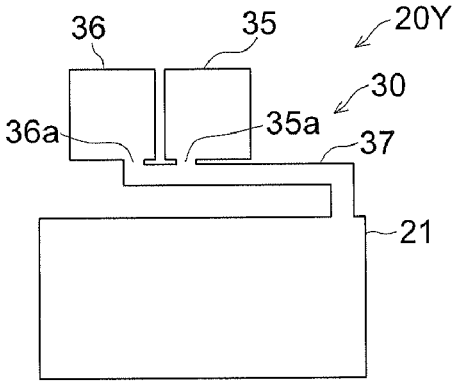
FIG. 6 is an explanation drawing to show an outline of another constitutional example of a development apparatus according to an image forming apparatus of this invention.

So far, an embodiment of this invention has been explained; however, this invention is not limited to the above-described embodiment and can be added with various modifications. For example, as shown in FIG. 6, in developer supply mechanism 30 of development apparatus 20Y installed in an image forming apparatus of this invention, possible is a constitution in which toner storing part 25 is arranged downstream to carrier storing part 36 in the conveying direction of developer conveying path 37, that is, toner ejection outlet 35*a* is arranged downstream to carrier ejection outlet 36*a* in the conveying direction of developer conveying path 37.

Figure 7:
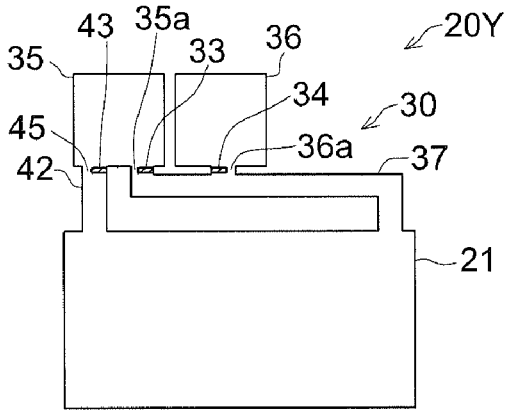
FIG. 7 is an explanation drawing to show an outline of further another constitutional example of a development apparatus according to an image forming apparatus of this invention.

Further for example, as shown in FIG. 7, in developer supply mechanism 30 of development apparatus 20Y installed in an image forming apparatus of this invention, possible is a constitution in which toner direct supply path 42 to directly supply direct developer storing part 21 with a new toner stored in toner storing part 35 without passing through developer conveying path 37. In this manner, in developer supply mechanism 30, since toner direct supplying path 42 is provided, for example, in the case of continuous printing of an original having a high coverage which requires a large amount of toner for image formation, supply response of a new toner becomes more excellent because a new toner can be rapidly supplied to developer storing part 21 by toner direct supplying path 42 having a conveying distance shorter than the conveying path via developer conveying path 37.

In the above-described developer supply mechanism 30, for example, toner storing part 35 is equipped with a toner supply opening 45 which ejects a new toner to toner direct supply path 42. This toner supply opening 45 is equipped with toner supply amount control section 43 to control an amount of a new toner supplied via toner direct supply path 42 from toner storing part 35. Further, toner supply amount control section 33 is provided with a supply instruction mechanism (not shown in the drawing) to send a supply start instruction and an instruction of the supply amount to toner supply amount control section 43 based on a new toner supply amount regulated according to a toner concentration value and a predetermined limit value. In this supply instruction mechanism (not shown in the drawing), for example, only in the case of a new toner supply amount exceeding a predetermined limit value, a supply start instruction and an instruction of the supply amount are sent to toner supply amount control section 43. A supply start instruction and an instruction of the supply amount are not sent to toner supply amount control section 43 in the case of a new toner supply amount is not more than a predetermined value.

In this embodiment, in the above-described development supplying mechanism 30, specifically, the following supplying motions of a new toner are performed.

That is, when a toner concentration of a developer in developer storing part 21 is detected by toner concentration detection section 25 and a new toner supply amount to be supplied to developer storing part 21 corresponding to the toner concentration value is A:

(a) In the case of A is not more than predetermined limit value B, direct supply of a new toner via toner direct supplying path 42 is not performed. That is, a new toner of amount A is ejected through toner ejection outlet 35*a* and this ejected new toner is conveyed on developer conveying path 37 while being stirred together with a new carrier ejected through carrier ejection outlet 36*a*, whereby supplying developer is supplied to developer storing part 21. And, for example, in toner supply amount control section 43 comprising a switching member such as a shutter, because of no toner supply start instruction and no instruction of the supply amount from a supply instruction mechanism in toner supply amount control section 33 are received, a switching member is kept closed not to perform supply of a new toner via toner direct supply path 42.

(b) In the case of A is over predetermined limit value B, direct supply of a new toner via toner direct supply path 42 is also performed. That is, a new toner of amount B is ejected through toner ejection outlet 35*a* and this ejected new toner is conveyed on developer conveying path 37 while being stirred together with a new carrier ejected through carrier ejection outlet 36*a*, whereby supplying developer is supplied to developer storing part 21. Simultaneous therewith, in toner supply amount control section 43, based on a supply start instruction and an instruction of supply amount (A-B) from supply instruction mechanism in toner supply amount control section 33, a switching member is kept open and a new toner of amount (A-B) is ejected through toner supply outlet 45 to be directly supplied to developer storing part 21 via toner direct supply path 42.

Figure 8:
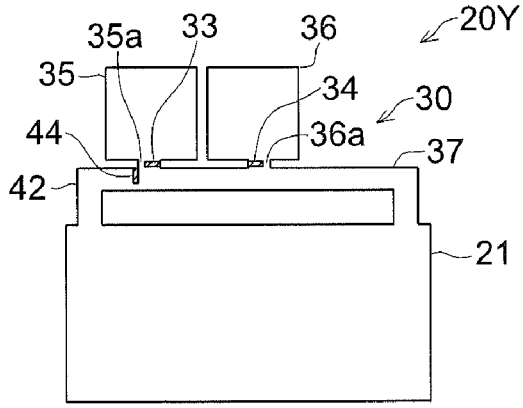
FIG. 8 is an explanation drawing to show an outline of further another constitutional example of a development apparatus according to an image forming apparatus of this invention.

Further, for example, as shown in FIG. 8, in developer supply mechanism 30 of development apparatus 20Y with which an image forming apparatus of this invention is equipped, possible is a constitution in which toner directly supplying path 42 to directly convey a new toner stored in toner storing part 35 to developer storing part 21 is arranged in one body with developer conveying path 37.

In such developer supply mechanism 30, for example, partial toner supply amount control section 44 to control the amount of a part of a new toner ejected through toner ejection outlet 35*a* to be shifted to toner direct supply path 42 is arranged at the boundary position between toner direct supply path 42 and developer conveying path 37. Further, toner supply amount control section 33 is provided with partial toner supply instruction mechanism (not shown in the drawing) to send a supply start instruction and an instruction of the supply amount to partial toner supply amount control section 44 based on a new toner supply amount defined according to a toner concentration value and a predetermined limit value. In this partial toner supply instruction mechanism (not shown in the drawing), a supply start instruction and an instruction of the supply amount are sent to partial toner supply amount control section 44 only in the case of a new toner supply amount exceeding a predetermined limit. That is, in the case of a new toner supply amount being not more than a predetermined limit value, no supply start instruction and no instruction of the supply amount are sent to partial toner supply amount control section 44.

In this embodiment, in the above-described development supplying mechanism 30, specifically, the following supplying motions of a toner are performed.

That is, when a toner concentration of a developer in developer storing part 21 is detected by toner concentration detection section 25 and a new toner supply amount to be supplied to developer storing part 21 corresponding to the toner concentration value is A:

(a) In the case of A is not more than predetermined limit value B, direct supply of a new toner via toner direct supplying path 42 is not performed. That is, a new toner of amount A is ejected through toner ejection outlet 35*a* and this ejected new toner is conveyed on developer conveying path 37 while being stirred together with a new carrier ejected through carrier ejection outlet 36*a*, whereby supplying developer is supplied to developer storing part 21. And, for example, in partial toner supply amount control section 44 comprising a switching member such as a shutter, because of no toner supply start instruction and no instruction of the supply amount are received from a partial toner supply instruction mechanism in toner supply amount control section 33, a switching member is kept in a closed state not to per form supply of a new toner via toner direct supply path 42.

(b) In the case of A is over predetermined limit value B, direct supply of a new toner via toner direct supply path 42 is also performed. That is, a new toner of amount A is ejected through toner ejection outlet 35*a*. And, in partial toner supply amount control section 44, based on a supply start instruction and an instruction of supply amount (A-B) from a partial toner supply instruction mechanism in toner supply amount control section 33, a switching member is kept open to shift a partial amount (A-B) of a new toner ejected through toner ejection outlet 35*a* to toner direct supply path 42 to be directly supplied to toner storing part 21 via toner direct supply path 42. Simultaneous therewith, a new toner of residual amount B among a new toner ejected through toner ejection outlet 35*a* is conveyed on developer conveying path 37 while being stirred together with a new carrier ejected through carrier ejection outlet 36*a*, whereby a supplying developer is supplied to developer storing part 21.

Figure 9:
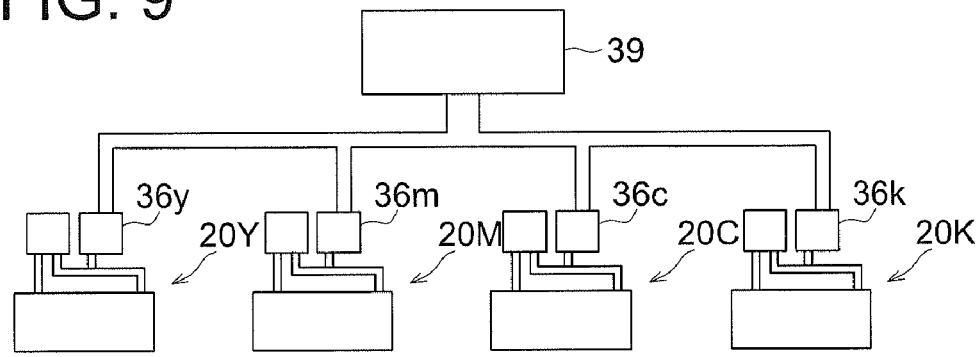
FIG. 9 is an explanation drawing to show an outline of further another constitutional example of a development apparatus according to an image forming apparatus of this invention.

Further, for example, as shown in FIG. 9, in an image forming apparatus of this invention, possible is a constitution in which carrier storing parts 36*y*, 36*m*, 36*c* and 36*k* in development apparatuses 20Y, 20M, 20C and 20K of each color are connected to carrier storing room 39. In carrier storing room 39, a new carrier common to each color is stored, and it is possible to save trouble of maintenance by an image forming apparatus having such a constitution.

Experimental Example 1

Utilizing an image forming apparatus equipped with development apparatus 20Y shown in FIG. 3, 100,000 sheets of an original (A4 size) having a coverage of 5% were continuously printed. Thereafter, 100,000 sheets of an original (A4 size) having a coverage of 30% were printed and the following evaluations of (1) and (2) were performed. Herein, in development supply mechanism 30 of an image forming apparatus according to this experimental example 1, a toner concentration of a developer in toner storing part 21 is supplying controlled to be 7% and a new carrier is supplying controlled by a switching member in toner supply amount control section 34 being controlled as shown in above-described table 1.

(1) Fog Evaluation

Figure 10:
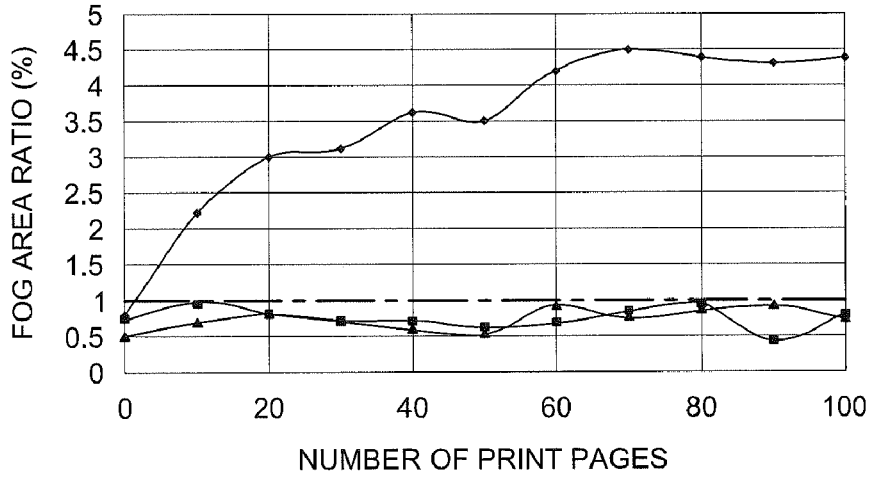
FIG. 10 is a graph to show a result of fog evaluation according to an experimental example.

As for fog evaluation, blank paper papering by a coated paper of A3 at every 10,000 sheets print during 100,000 sheets printing of an original (A4 size) having a coverage of 30% was performed, and fog area ratio K (%) shown by following equation (1) was measured. When a fog area ratio is less than 1%, there is no practical problem. The result is shown in FIG. 10. Herein, in FIG. 10, a plot shown by "▲" shows the result according to experimental example 1, a plot shown by "◆" shows the result according to reference experimental example 1, and a plot shown by "■" shows the result according to comparative experimental example 2. Equation (1): K=(total dot area of adhered toner on coated paper/area of coated paper)×100

(Surplus Developer Removal Amount)

As for a surplus developer removal amount, after continuous 100,000 sheets printing of an original (A4 size) having a coverage of 5% and after continuous 100,000 sheets printing of an original (A4 size) having a coverage of 30%, a mass of surplus developer removed by a surplus developer wasting section was measured. The result is shown in table 2.

Comparative Experimental Example 1

Figure 11:
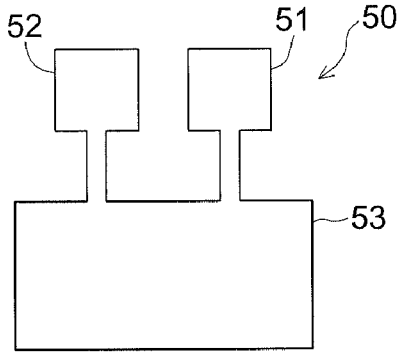
FIG. 11 is an explanation drawing to show an outline of a constitutional example of a development apparatus according to a conventional image forming apparatus.

The above-described evaluations of (1) and (2) were made in a similar manner to experimental example 1, except that an image forming apparatus equipped with development apparatus 50 shown in FIG. 11 was utilized. Herein, a new toner is supplying controlled so as to make the toner concentration of a developer in developer storing part 53 of 7%, a new carrier being controlled so that 10 mg is supplied at every 10 seconds elapse of drive time of development apparatus 50, and the both are supplied to developer storing part 53 without being stirred.

Comparative Experimental Example 2

Figure 12:
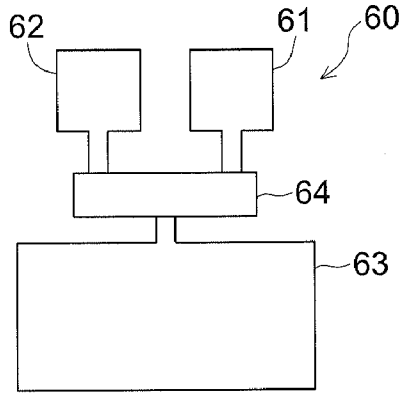
FIG. 12 is an explanation drawing to show an outline of another constitutional example of a development apparatus according to a conventional image forming apparatus.

The above-described evaluations of (1) and (2) were made in a similar manner to experimental example 1, except that an image forming apparatus equipped with development apparatus 60 shown in FIG. 12 is utilized. Herein, in this image forming apparatus according to comparative experimental example 2, a volume of intermediate bath 64 is 350 cc, a new toner and a new carrier being supplying controlled to intermediate bah 64 so as to make a trickle rate of supplying developer in intermediate bath 64 of 10 weight %, and, after having been circulating stirred in intermediate bath 64, are supplying controlled so as to make a toner concentration of a developer in developer storing part 63 of 7%.

TABLE 2

| | Surplus developer removing amount (g) | |
|---|---|---|
| | After 100,000 sheets printing of an original having a coverage of 5% | After 100,000 sheets printing of an original having a coverage of 30% |
| Experimental example 1 | 300 | 300 |
| Comparative experimental example 1 | 300 | 300 |
| Comparative experimental example 2 | 300 | 1800 |

As a result of FIG. 10, in an image forming apparatus of this invention according to experimental example 1, it was possible to restrain broadening of charge amount distribution of a toner and no samples exceeded fog area ratio of 1%.

On the other hand, in an image forming apparatus according to comparative experimental example 1, charge amount distribution became broad and every sample exceeded toner fog area ratio of 1%. The reasons why charging amount distribution of a toner became broad are considered to be the following two.

(1) A reason that since a new carrier has higher charge giving ability against the same toner compared to a carrier existing already in developer storing part 53 (hereinafter, also referred to as "an existing carrier") due to the surface of a new carrier being clean, as well as a new carrier is hard to be dispersed in developer storing part 53 due to having a larger specific gravity compared to a toner, whereby a carrier having a high charging ability has been concentrated to one position in developer storing part 53.

(2) A reason that as for a toner existing already in developer storing part 53 (hereinafter, also referred to as "an existing toner"), since transfer of an additive which contributes to charging on an existing carrier has been already performed; however, existing toner transfers an additive also to a new carrier by supply of a new carrier into developer storing part 53, shortage of an additive of existing toner will result And, such an existing toner being short of an additive was subjected to toriboelectric charging together with an existing carrier to decrease the charging amount.

Further, in an image forming apparatus according to comparative experimental example 2, broadening of charge amount distribution of a toner was restrained and no samples exceeded a fog area ratio of 1% due to a preliminary stirring of a toner and a carrier in intermediate tank 64.

As a result of table 1, in an image forming apparatus according to experimental example 1 and comparative experimental example 1, in the case of continuous printing of 100,000 sheets of an original having coverage of 30%, the removed amount of a surplus developer was decreased to restrain increase of CCP because supply of a new carrier was controlled by drive time of development apparatus 20Y to supply a suitable amount of a new carrier. On the other hand, in an image forming apparatus according to comparative experimental example 2, in the case of continuous printing of 100,000 sheets of an original having coverage of 30%, the removed amount of a surplus developer was excessive not to restrain increase of CCP because supply of a new carrier was performed based on supply of a new toner.

It has been confirmed based on the above description that an image forming apparatus of this invention is able to stably form high quality images over a long term without generation of fog as well as to restrain increase of CCP in the case of printing an original having a high coverage.

What is claimed is:

1. An image forming apparatus provided with a development apparatus, the development apparatus comprising:

a developer storing part to store a two-component developer comprising a toner and a carrier for development of an electrostatic latent image carried on an image carrier;

a developer supply mechanism to supply a supplying developer to the developer storing part; and a surplus developer removing section to remove a surplus two-component developer from the developer storing part;

wherein said developer supply mechanism comprises:

a toner storing part;

a carrier storing part;

a developer conveying path arranged between the toner storing part and the developer storing part, and between the carrier storing part and the developer storing part;

a conveying mechanism arranged between the toner storing part and the developer storing part; and between the carrier storing part and the developer storing part;

a toner supply amount control section to control a toner amount supplied from the toner storing part to the developer conveying path; and a carrier supply amount control section to control a carrier amount supplied from the carrier storing part to the developer conveying path;

wherein said developer conveying path being provided with, on one end of the conveying path, a toner ejection outlet through which a toner stored in the toner storing part is ejected and a carrier ejection outlet through which a carrier stored in the carrier storing part is ejected, and on the other end, a supplying developer ejection outlet through which a supplying developer is ejected to the developer storing part; and the toner ejected through the toner ejection outlet and the carrier ejected through the carrier ejection outlet are conveyed from the one end toward the other end while being stirred by the conveying mechanism.

2. The image forming apparatus of claim 1, wherein said development apparatus further comprises a toner concentration detection section to detect a toner concentration of the two-component developer in the developer storing part and a drive time detection section to detect drive time of the development apparatus, and wherein the toner supply amount control section controls a toner amount supplied from the toner storing part to the developer conveying path depending on a toner concentration value detected by the toner concentration detection section and the carrier supply amount control section controls a carrier amount supplied from the carrier storing part to the developer conveying path depending on a drive time value detected by the drive time detection section.

3. The image forming apparatus of claim 1, wherein the toner storing part is arranged upstream of the carrier storing part in a conveying direction of developer conveying path.

4. The image forming apparatus of claim 1, wherein the developer supply mechanism comprises a toner direct supply path to directly supply a developer stored in the toner storing part to the developer storing part.

5. An image forming apparatus provided with a development apparatus, the development apparatus comprising:

a developer storing part to store a two-component developer comprising a toner and a carrier for development of an electrostatic latent image carried on an image carrier;

a developer supply mechanism to supply a supplying developer to the developer storing part;

a surplus developer removing section to remove a surplus two-component developer from the developer storing part;

a toner concentration detection section to detect a toner concentration of the two-component developer in the developer storing part; and a drive time detection section to detect drive time of the development apparatus wherein said developer supply mechanism comprises:

a toner storing part;

a carrier storing part;

a developer conveying path arranged between the toner storing part and the developer storing part, and between the carrier storing part and the developer storing part;

a conveying mechanism arranged between the toner storing part and the developer storing part; and between the carrier storing part and the developer storing part;

a toner supply amount control section to control a toner amount supplied from the toner storing part to the developer conveying path depending on a toner concentration value detected by the toner concentration detection section; and a carrier supply amount control section to control a carrier amount supplied from the carrier storing part to the developer conveying path depending on a drive time value detected by the drive time detection section;

wherein said developer conveying path being provided with, on one end of the conveying path, a toner ejection outlet through which a toner stored in the toner storing part is ejected and a carrier ejection outlet through which a carrier stored in the carrier storing part is ejected, and on the other end, a supplying developer ejection outlet through which a supplying developer is ejected to the developer storing part; and the toner ejected through the toner ejection outlet and the carrier ejected through the carrier ejection outlet are conveyed from the one end toward the other end while being stirred by the conveying mechanism.

6. The image forming apparatus of claim 5, wherein the toner storing part is arranged upstream of the carrier storing part in a conveying direction of developer conveying path.

7. The image forming apparatus of claim 5, wherein the developer supply mechanism comprises a toner direct supply path to directly supply a developer stored in the toner storing part to the developer storing part.

* * * * *